US005707924A

United States Patent [19]

Vaughn et al.

[11] Patent Number: 5,707,924

[45] Date of Patent: Jan. 13, 1998

[54] METHOD FOR PRINTING

[75] Inventors: Larry F. Vaughn, 1158 Mansfield Ave., Indiana, Pa. 15701; John G. Whitaker, Chattanooga, Tenn.

[73] Assignee: Larry F. Vaughn, Indiana, Pa.

[21] Appl. No.: 744,243

[22] Filed: Nov. 5, 1996

Related U.S. Application Data

[62] Division of Ser. No. 551,824, Nov. 7, 1995.

[51] Int. Cl.[6] ..... B41M 5/165

[52] U.S. Cl. ..... 503/201; 503/213; 503/215

[58] Field of Search ..... 427/150–152; 503/201, 213, 215–218, 225

[56] References Cited

U.S. PATENT DOCUMENTS

| | | | |
|---|---|---|---|
| 3,578,482 | 5/1971 | Whitaker et al. | 117/38 |
| 3,819,396 | 6/1974 | Vincent et al. | 117/36.2 |
| 4,232,083 | 11/1980 | Buerkley et al. | 428/307 |
| 4,262,936 | 4/1981 | Miyamoto | 282/27.5 |
| 4,302,393 | 11/1981 | Garner et al. | 260/335 |
| 4,379,178 | 4/1983 | Meadows et al. | 427/1 |
| 4,699,077 | 10/1987 | Meadows et al. | 118/31.5 |
| 5,009,919 | 4/1991 | Vassiliades | 427/1 |
| 5,454,600 | 10/1995 | Floyd | 293/78 |

OTHER PUBLICATIONS

Mead Carbonless Tech Notes, Sixth Edition, Oct., 1992.

*Primary Examiner*—Bruce H. Hess
*Attorney, Agent, or Firm*—Luedeka, Neely & Graham, P.C.

[57] ABSTRACT

The invention described herein relates to methods mid systems for printing. More specifically, the present invention provides methods and systems for printing using a disposable substrate containing an essentially dry layer of microcapsules which contain a colorless dye solution in a first substrate region and a substantially dry layer of dye developing compound in a second substrate region. The disposable printing system according to the invention provides a reduced availability for bacterial growth and transfer due to its essentially dry characteristics.

25 Claims, 4 Drawing Sheets

METHOD FOR PRINTING

This application is a division of application Ser. No. 08/551,824, filed Nov. 7, 1995 and pending.

The present invention relates to printing methods. More specifically, the present invention provides a method and system for printing images using an essentially dry colorless, dye containing, substrate. By "essentially dry" it is meant that the substrate is dry to the touch provided the contact with the substrate is not sufficient to break one or more microcapsules containing a colorless dye solution.

According to one aspect, the invention provides a printing system comprising a first substrate region containing an essentially dry layer comprising a plurality of microcapsules wherein the microcapsules contain a colorless dye solution. An image containing device is provided for contacting the microcapsule layer of the substrate and transferring a portion of the dye solution to the image containing device. The image containing device preferably has a rigid base, a handle fixedly attached to one surface of the base and an image having a raised portion attached to an opposing surface of the base. An image receiving second substrate region is provided for contacting the image containing device in order to transfer the colorless dye solution from the image containing device to the second substrate region wherein the image receiving substrate region comprises an substantially dry layer of a dye developing compound.

According to another aspect, the invention provides a method for printing an image on a substrate. The method comprises providing a dye containing first substrate region comprising an essentially dry layer of microcapsules and binder wherein from about 50 to about 99 percent of the microcapsule weight is a colorless dye solution. The first substrate region is then contacted with an image containing object in a manner sufficient to break at least a portion of the microcapsules and to transfer at least a portion of the colorless dye solution from the broken microcapsules to the image containing object. At least a portion of the colorless dye solution may then be transferred from the image containing object to a second substrate region comprising a substantially dry dye developing compound by contacting the image containing object with the second substrate region to produce a visible image of the object on the second substrate region.

An advantage of the invention is that the images may be formed without the use of pigmented inks or dyes which may cause staining on clothing, skin or any other object which comes in contact with the colorless dye solution and which will not react with the colorless dye solution to develop the dye. Another advantage of the invention is that the printing system is relatively inexpensive since both the first and second substrate regions containing microcapsules and dye developing compound, respectively, may be prepared by depositing a colorless dye layer and a dye developing layer on the substrate regions, preferably a paper or paperboard substrate, thereby obviating the need for a structural container for a moist pad to retain an ink or dye solution and/or a developing solution. Because the printing systems according to the invention use an essentially dry microcapsule layer containing a colorless dye solution, the system is readily transportable and may be used in a variety of situations, particular with children, without worrying about having to clean the inks or dyes from objects contacted by the microcapsule containing substrate.

Unlike traditional ink pads which may be used multiple times, the first substrate region of microcapsules, according to the present invention, may be discarded after an initial or single use. Since an absorbent ink pad is not required in order to use the printing system according to the present invention, there is less tendency for bacteria to accumulate on the first substrate region comprising microcapsules and binder. By eliminating a moist media which may promote the growth of bacteria, the transfer of bacteria from one individual to another is substantially reduced, particularly when contacting the first substrate region with the fingers of multiple individuals.

In yet another aspect, the invention provides a disposable ink pad and image producing system for producing images using an image containing object without visibly tinting the image containing object. The system comprises a paper or paperboard substrate having printed in a first region on the surface of the substrate, an essentially dry layer of microcapsules and binder wherein from about 50 to about 99 percent of the microcapsule weight is a colorless dye solution for depositing a colorless dye on the image containing object and having printed in a second coplanar region on the surface of the substrate a substantially dry dye developing layer for receiving the colorless dye from the image containing object to produce the image on the substrate in the second region.

BRIEF DESCRIPTION OF THE DRAWINGS

Other features and advantages of the invention will be described and understood by referring to the drawings in combination with the following description in which.

DETAILED DESCRIPTION OF THE INVENTION

Figure 1:
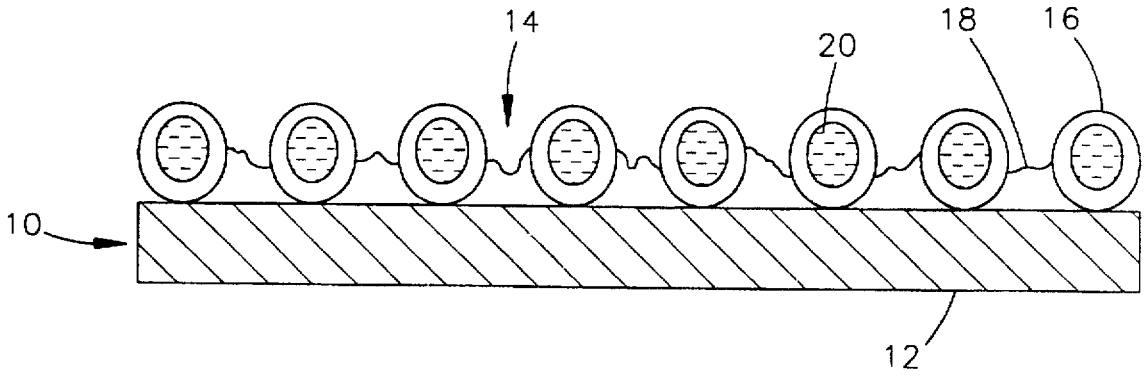
FIG. 1 is a cross-sectional view, not to scale of the microcapsule containing substrate.

With reference to FIG. 1, there is provided an essentially dry, disposable ink pad 10 comprising a substrate 12 having deposited thereon a layer 14 containing microcapsules 16 and a binder 18. The binder 18 is used to adhere the microcapsules 16 to the substrate 12. The microcapsules 16 contain a colorless dye solution 20 which is released from the ink pad 10 when the microcapsules are ruptured.

In order to provide sufficient colorless dye solution for transfer to a second substrate region containing a dye developing compound, it is preferred that the microcapsules 16 have an average effective spherical diameter of from about 40 to about 80 microns. Since the microcapsules 16 are often elliptical in cross-sectional shape due to the method used to manufacture the microcapsules, the "effective spherical diameter" is the diameter of a sphere having substantially the same volume as the microcapsule. It is preferred that the amount of colorless dye solution 20 in each microcapsule 16 be from about 50 to about 99 percent by weight of the total weight of the microcapsule and dye.

The microcapsules 16 are designed so that they are deformable and not easily ruptured when contained in a liquid medium so that they may be deposited on a substrate 12 without rupturing or with only a minor amount of ruptured microcapsules 16. Typically, less than about 2 percent by weight of the microcapsules may rupture during the deposition process used to deposit the microcapsules and binder on the substrate.

In order to deposit the microcapsules 16 on the first substrate region, the microcapsules and binder are preferably printed rather than coated onto the substrate 12. Printing of the microcapsule layer 14 provides more precise location of the microcapsule layer with respect to substrate region to be used for the microcapsule layer. Printing methods which may be used to deposit the microcapsule layer 14 microcapsules 16 and binder 18 on a paper or paperboard substrate 12 may be selected from, but not limited to, flexo-graphic printing, silk screen printing and offset or gravure printing. The preferred printing method is a silk screen method wherein the silk screen has been prepared in ways well-known in the art so that a liquid microcapsule dispersion and binder may be deposited onto the desired area or areas of the substrate 12.

During silk screen printing the microcapsule dispersion containing from about 20 to about 40 percent by weight microcapsules, preferably about 25 percent by weight microcapsules, and binder are placed on the surface of the silk screen or rubber plate opposite the substrate 12 and a squeegee is passed over the top surface of the screen or rubber plate in order to force the microcapsule dispersion and binder through the open portions of the screen or rubber plate and onto the substrate 12 to form the layer 14. The mesh size of the silk screen or the percentage of line screen of the flexo-graphic plate is selected to allow a sufficient thickness of the layer containing microcapsules and binder to be deposited on the substrate. The preferred screen for silk screen printing is a 200 mesh screen with an opening size of approximately 125 microns and the weight of microcapsules and binder deposited using the preferred screen ranges from about 3 to about 6 pounds per 3000 square feet of substrate (about 4.7 to about 9.7 grams/$m^2$), most preferably about 4 pounds per 3000 square feet (about 6.4 grams/$m^2$) of substrate.

As was previously described, the microcapsules are of a construction which enables the microcapsules to be deformable while in a liquid dispersion so that the shear forces incurred during the deposition process are insufficient to rupture the majority of the microcapsules. A preferred method for depositing microcapsules onto the surface of a substrate is disclosed in U.S. Pat. No. 3,578,482 to Whitaker et al. incorporated herein by reference as if fully set forth.

Subsequent to deposition, the layer 14 adheres to the substrate 12 by action of the binders and the substrate containing layer 14 is allowed to dry either by unassisted air drying or assisted heat drying. Upon drying, the layer 14 consists of a dried mixture of binder 18 and microcapsules 16 which contain liquid colorless dye solution 20. After the layer 14 containing the binder 18 and microcapsules 16 has dried on the substrate 12 so that the microcapsules are effectively bound to the substrate, the colorless dye containing layer 14 is ready for use.

The colorless dye used in the microcapsules 16 of layer 14 may be selected from one or more vat dye intermediates which are often insoluble in water in their natural or oxidized state, but are colorless and soluble in water at a neutral or alkaline pH. Accordingly, the colorless dyes may be selected from, but not limited to, lactones, dilactones, derivatives of bis-(p-dialkylaminoaryl)methane, zanthenes, indolyls, auramines, fluorans, bisfluorans. Specific colorless dyes include, indigo, inanthrene blue, benzoyl leuco methylene blue, 3,3-bis(1'-n-octyl-2'-methyl-indol-3'-yl) phthalide, crystal violet lactone, 2-(N-benzyl-N-n-octyl) amino-6-diethylaminofluoran and 6'-(diethylamino)-3'-methyl-2'-(phenylamino)spiro(isobenzofuran-1(3H),9'-(9H) xanthen)-3-one.

The colorless dye is preferably dissolved in an oleaginous material. Typically, the colorless dye solution will contain from about 10 to about 20 percent by weight of colorless dye and from about 80 to about 90 percent by weight of oleaginous material. The oleaginous material may be selected from a citrus oil such as lemon oil, orange oil, grapefruit oil or lime oil, a water insoluble fatty acid, an aliphatic ester and similar oleaginous materials.

The binder 18 for binding the microcapsules 16 to the substrate 12 may be selected from gum arabic, methyl cellulose, polyvinyl alcohol, starch, polyacrylic acid, carboxymethyl cellulose, ethylcellulose, cellulose acetate, polyvinyl acetate, polyvinylpyrrolidone, polyacrylamide, shellac, natural gums, hydroxypropyl cellulose and other compounds having similar properties. Preferred binders include methyl cellulose and hydroxypropyl cellulose.

Figure 2:
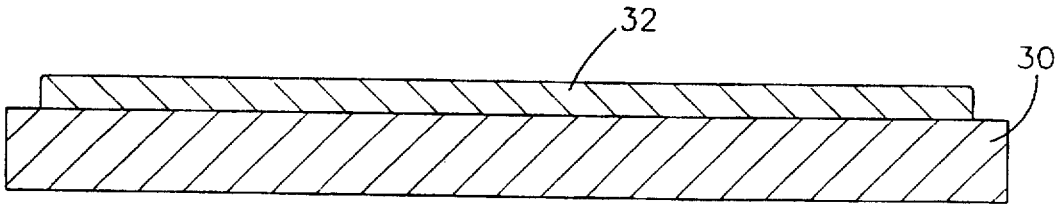
FIG. 2 is a cross-sectional view, slot to scale of a substrate containing the dye developing compound.
Figure 3:
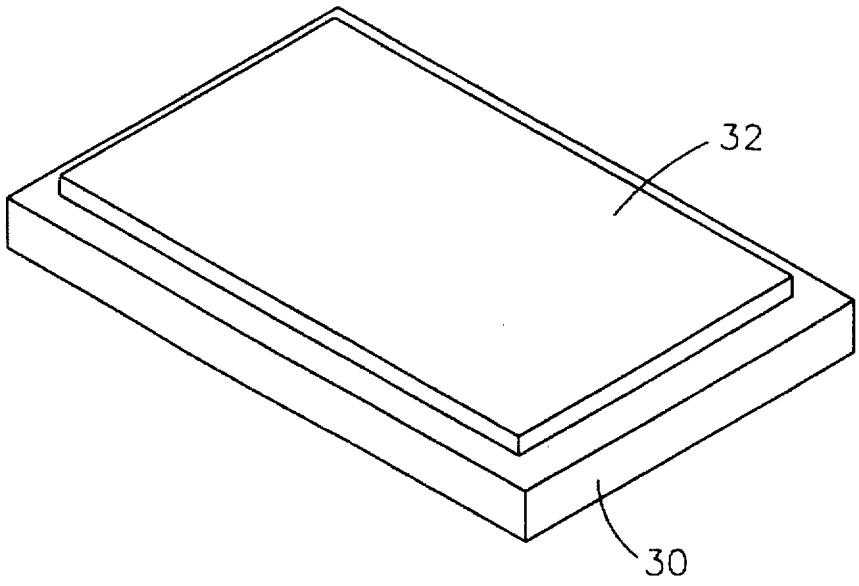
FIG. 3 is a prospective view of the substrate of FIG. 2 containing the dye developing compound.

Another important component of the printing system according to the invention is a substrate 30 or second substrate region containing a layer 32 comprising a dye developing compound as illustrated in FIGS. 2 and 3. The dye developing layer 32 is a substantially dry layer containing a compound which in contact with the colorless dye solution, reacts with the dye solution to oxidize the dye and convert the dye to the colored or tinted form. Preferred compounds for the dye developing layer 32 are compounds which are electron-accepting substances and may be selected from, but not limited to, acidic clays such as montmorillonites, kaolins, talc, bentonites, and attapulgites; phenolic resins; metal oxides; metal chlorides; derivatives of aromatic carboxylic acids and their metal salts, aliphatic dicarboxlic acids and novolac phenolic resins. Examples of one or more compounds which may be present in the dye developing layer 32 include, but are not limited to, aluminum silicate, calcium citrate, 4-tertbutylphenol, 4-phenylphenol, 4-hydroxydiphenyloxide, α-naphthol, 4-hydroxybenzoic acid methyl ester, β-naphthol, 4-hydroxyacetophenone, 2,2'-dihydroxydiphenyl, 4,4'-isopropylidenendiphenol, 4,4-'isopropyliden-bis-(2-methylphenol), 4,4'-bis(hydroxyphenyl) valeric acid, hydroquinone, pyrogallol, chloroglucinol, p-, m-, o-hydroxybenzoic acid, gallic acid, 1-hydroxy-2-naphthoic acid, boric acid, tartaric acid, oxalic, acid, maleic acid, citraconic acid and succinic acid. A particularly preferred dye developing compound is an alkylphenol novolac resin dispersion which is commercially available from Schenectady International, Inc. of Schenectady, N.Y. under the trade name HRJ-4023.

As with the microcapsule layer 14, the dye developing layer 32 is preferably deposited on the substrate 30 by any of the beforementioned printing methods with a conventional flexo-graphic printing method being the most preferred. Binders such as those for use with the microcapsule layer 14 may also be used to adhere the dye developing layer 32 to the substrate 30. However, when the dye developing compound is an alkylphenol novolac resin, no additional binders are required as the resin itself acts as a binder. The amount of dye developing compound deposited on the substrate preferably ranges from about 1 pound per 3000 square feet (1.6 grams/m$^2$) to about 3 pounds per square feet (4.7 grams/m$^2$), preferably about 2 pounds per 3000 square feet (3.2 grams/m$^2$).

Figure 4:
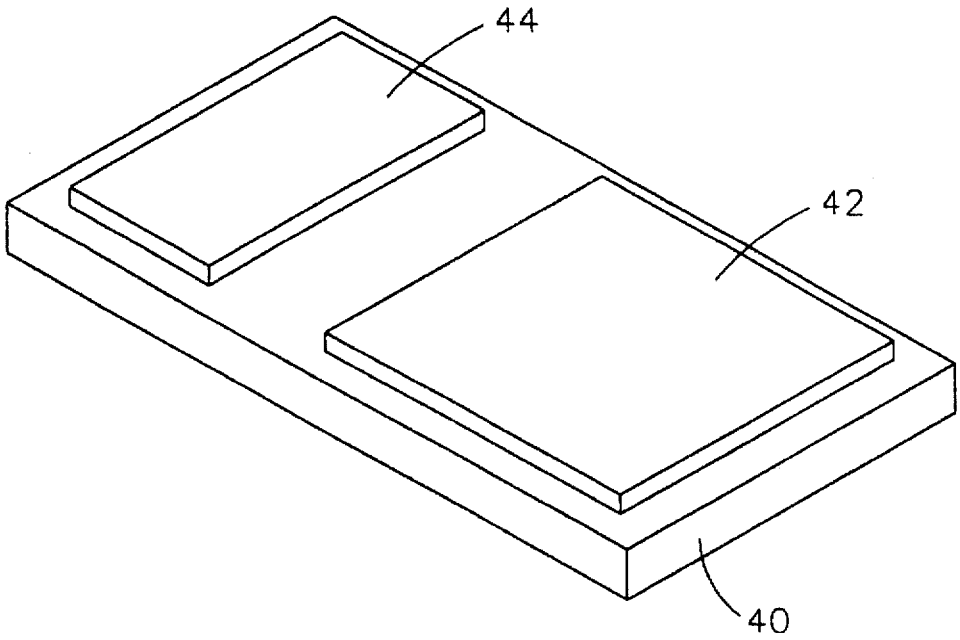
FIG. 4. is a prospective view of a substrate containing both the microcapsule layer and the dye developing layer.

The dye developing layer 32 may be deposited on the same substrate 12 in a second substrate region with respect to the first region containing the microcapsule layer or on a separate substrate 30. When deposited on the same substrate as the microcapsule layer, it is preferred to deposit the dye developing layer 32 in a spatially separate, coplanar location on the same surface of the substrate 12 as the microcapsule layer 14. FIG. 4 illustrates a substrate 40 having both the microcapsule layer 42 containing colorless dye solution and the dye developing layer 44 made of a substantially dry dye developing compound. Once deposited on the substrate 30 or 40, the dye developing layer 32 or 44 is dried by air or heat so that the layer is substantially dry to the touch.

While it is preferred to deposit the microcapsule layer 14 and dye developing layer 32 on a paper or paperboard substrate, any suitable substrate may be used including, but not limited to, a coated paper product, wood, plastic or metal.

In order to use the printing system according to the invention, a plurality of microcapsules 16 in the microcapsule layer 14 are broken by pressure from an image containing object and a portion of the colorless dye solution 20 is transferred to the surface of the image containing object. Next, at least a portion of the colorless dye solution 20 which was transferred to the image containing object is transferred to the second substrate region containing the dye developing compound 32 by contacting the second substrate region with the image containing object. Contact between the colorless dye solution 20 and the dye developing compound causes a reaction between the colorless dye solution 20 and the color developing compound so that an oxidized form of the dye, which is highly colored, is produced.

Figure 5:
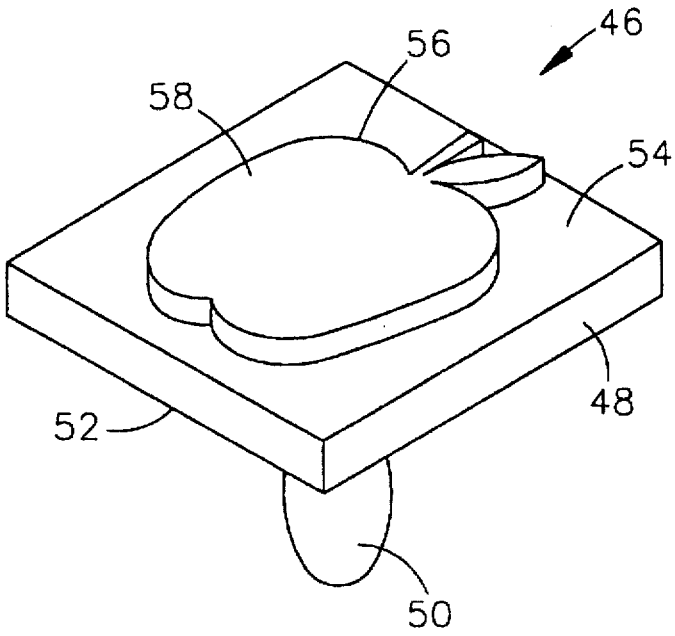
FIG. 5 is a prospective view of an image containing device.
Figure 6:
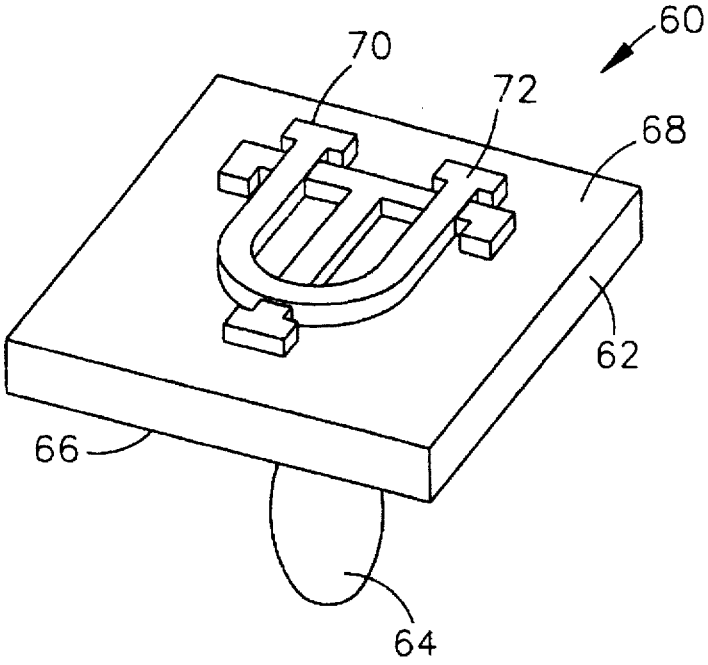
FIG. 6 is a prospective view of another image containing device.

Suitable image containing objects 46 and 60 are illustrated in FIGS. 5 and 6 respectively. The image containing object 46 or 60 may contain a rigid base 48 or 62 and a handle 50 or 64 fixedly attached to one surface 52 or 66 of the base 48 or 62 respectively. An opposing surface 54 or 68 of the image containing object 46 or 60 contains an image 56 or 70 which has a surface 58 or 72 respectively, substantially parallel to and offset from the surface 54 of 68 of the object 46 or 60. It is preferred that only surface 58 or 72 retain the portion of colorless dye 20 as a result of contacting the image containing object 46 or 60 with the first substrate region of microcapsules 16. The surface 58 or 72 should not be so absorbent however, that it inhibits the subsequent transfer of a portion of the colorless dye from the image containing object 46 or 60 to the second substrate region containing the dye developing compound 32.

The image portion 56 or 70 of the image containing object 46 or 60 may be made from an elastomeric material such as natural or synthetic rubber which may be attached by a suitable adhesive or any other attachment method known to those of skill in the art to a plastic or wooden rigid base 48 or 62. Other image containing objects may also be used including, but not limited to, metal dyes, fingers and other useful or ornamental surfaces having sufficient relief for the contact and transfer of colorless dye from the first substrate region of microcapsules to the second substrate region of dye developing compound.

In another embodiment, there is provided an image producing system comprising a first substrate region comprising an essentially dry layer of fluid filled microcapsules and binder. The microcapsules in the first substrate region preferably have an average spherical diameter of from about 40 to about 80 microns and contain a fluid selected from the group consisting of colorless dye solutions, preferably a colorless vat dye solution as described herein and dye developing solutions, preferably an alkylphenol novolac resin solution. There is also provided a second substrate region having printed thereon a substantially dry compound which compound is reactive with the fluid from the microcapsules and wherein the compound is printed on the second substrate region in the shape of text or a design. An important aspect of the invention is that the printed compound is substantially imperceptible prior to reaction with the microcapsule fluid and the printed compound becomes visible subsequent to reaction with the microcapsule fluid. One use for the image developing system is as a game piece or game board wherein contact between the fluid from the microcapsules and the area of the second substrate region containing the image to be developed produces a visibly correct or incorrect answer to a question.

Figure 7:
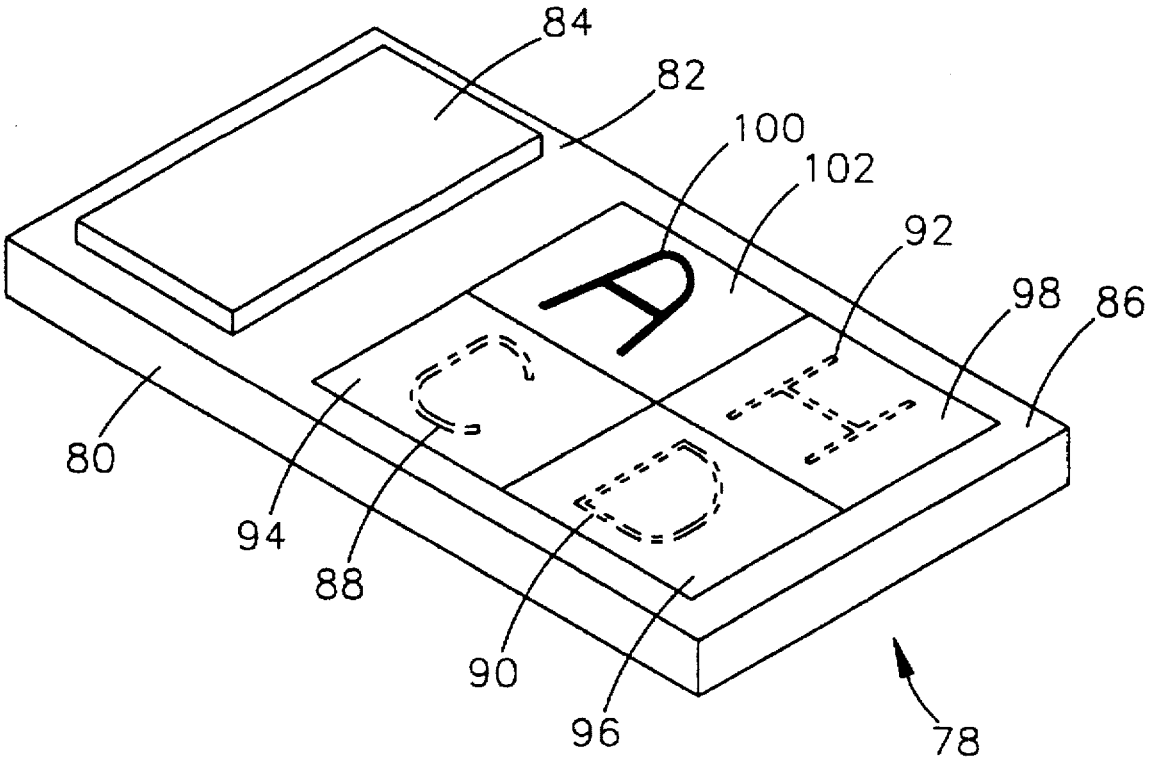
FIG. 7 is a prospective view of a substrate containing a colorless dye first region and a printed dye developing compound in a second substrate region.

FIG. 7 illustrates various features of the image producing system 78 according to the invention. In this embodiment, there is provided a substrate 80 having a first substrate region 82 comprising an essentially dry layer 84 of fluid filled microcapsules and binder and a second substrate region 86 having printed thereon a substantially dry compound in the shape of text or a design. The second substrate region may contain a single design or text in a single location, or, as illustrated in FIG. 7, the second region may contain a plurality of sections each containing text or a design. The compounds 88, 90 and 92 printed in sections 94, 96 and 98 respectfully of the second substrate region are shown in outline form to represent designs or text which are substantially imperceptible before contact with the fluid from the microcapsules. The compound 100 in section 102 of the second substrate region is in solid form to represent the compound after reaction with the fluid from the microcapsules. After reaction between the microcapsule fluid and the compound in section 102 of the second region 86, the image becomes visible whereas the images in sections 94, 96 and 98 remain substantially imperceptible in the absence of reaction between the microcapsule fluid and the compound in those sections.

In order to use the image producing system illustrated in FIG. 7, an object such as a finger or absorbent media is pressed or rubbed on the microcapsule layer 84 with a pressure sufficient to break at least a portion of the microcapsules and release fluid to the object. The object may then be rubbed over the second substrate region 86 in a selected area so that sufficient fluid from the object may be transferred from the object and react with the printed compound so that the image may change from substantially imperceptible to visible as shown in section 102 by design 100.

In another aspect, the invention provides a method for making an essentially dry printing system. The method comprises milling an aqueous gelatin mixture containing water, a solution containing about 10 to about 20 percent by weight of a vat dye and about 80 to about 90 percent by weight of an oleaginous material to an oil droplet size of about 40 to about 80 microns. The milled dye droplets in the aqueous gelatin mixture are then dispersed in an aqueous gum arabic solution while mixing the dispersion at a speed sufficient to maintain the particle size. During mixing, the dispersed mixture is cooled to a temperature in the range of from about 5 to about 15° C., preferably about 10° C. When the desired temperature is obtained, a crosslinking agent is added to the dispersed mixture to form the microcapsules. The cooled solution is then maintained under agitation for from about 10 to about 20 hours at a pH of about 4.5. At the end of the holding period, water is removed from the dispersed mixture containing microcapsules, preferably by filtration, to obtain a mixture with a microcapsule content of about 20 to about 30 percent by weight. The microcapsule containing mixture is then deposited, preferably by a printing process, with a binder in a first substrate region on a surface of a paper or paperboard substrate to provide a microcapsule and binder layer and the microcapsule and binder layer is dried. A layer of an electron accepting compound and binder is printed in a second substrate region on the surface of a substrate, preferably the same surface of the same substrate in a spatially separate, coplanar location with respect to the microcapsule and binder layer.

The microcapsule layer may contain other ingredients in addition to the colorless dye. Accordingly, a fragrance compound may be included with the colorless dye solution to give the image a distinctive fragrance. Fragrances which may be used include the natural citrus oils such as lemon, grapefruit, lime and orange oils, spearmint as well as synthetic fragrances such as strawberry, watermelon and chocolate.

The following example illustrates a process for preparing a microcapsule layer 14 containing colorless dye solution according to the invention.

EXAMPLE 1

A mixture of 90 mL of an 11 wt. % aqueous gelatin solution, 120 mL of COPIKEM 4 (a black colorless dye solution containing an oleaginous material available from Hilton Davis Go. Of Cincinnati, Ohio) and 100 milliliters of water were milled in a WARING blender on a medium speed at a temperature of about 35° C. and a pH in the range of 4.75 to 5.0 for a period of time sufficient to obtain emulsified droplets having an average effective spherical diameter of about 40 to about 80 microns. The emulsion was then added to a 1000 mL beaker containing 90 mL of an 11 wt. % gum arabic solution, and 300 mL of dilution water while agitating the mixture at a speed sufficient to maintain the particle size of 40 to 80 microns. The resulting system was cooled slowly from 35° C. to 26° C. over a period of 4 hours. At 26° C. the pH of the system was lowered to 4.5 using acetic acid. After adjusting the pH, the 1000 mL beaker containing the liquid was placed in an ice bath to quickly cool the system to 10° C. At this point, 5 mL of glutaraldehyde were added to assist in solidification of the microcapsule walls. At this point the liquid contained about 20 wt. % microcapsules dispersed in water. The microcapsules were concentrated to about 25 wt. % by filtration and 1 wt. % each of methylcellulose and KLUCEL resins (commercially available from Aqualon of Wilmington, Del.) were added to the dispersed microcapsules. The mixture was then printed onto a paperboard substrate by a silk screen printing process using a 200 mesh screen to provide 4 pounds per 3000 square feet (6.4 grams/m$^2$) of the microcapsule layer. The printing process used was generally in accordance with the procedure disclosed in U.S. Pat. No. 3,758,482 to Whitaker et al. incorporated herein by reference as if fully set forth. The printed product was allowed to dry completely.

The substrate containing the dye developing compound was prepared according to the following example.

EXAMPLE 2

An aqueous emulsion of an alkylphenol novolac resin dispersion containing 55 weight percent solids (trade name HRJ-4023 commercially available from Schenectady International, Inc. of Schenectady, N.Y.) was deposited by a conventional flexo-graphic printing process on a paperboard substrate. The coating thickness was about 2 pounds per 3000 square feet (3.2 grams/m$^2$). The dye developing layer was allowed to dry completely before use.

Slight pressure was used to contact and rub the microcapsule containing layer with a finger to break a portion of the microcapsules and obtain a portion of the colorless dye on the finger. The finger was then pressed to the portion of a substrate containing the dye developing layer. A black image of the fingerprint was obtained on the dye developing coating with no transfer of color to the finger.

In yet another embodiment of the printing system according to the invention, the microcapsule layer illustrated in FIG. 1 contains the dye developing compound dissolved in a suitable hydrophobic solvent such as xylene or toluene, and the layer illustrated in FIGS. 2 and 3 contains a substantially dry coating of a colorless dye compound. In all other aspects, the methods and uses of the foregoing printing system of the invention is substantially the same as the system wherein the microcapsules contain the colorless dye.

Having described and illustrated preferred embodiments of the invention, it will be recognized that the substrate and/or either of the layers on the substrate may contain other ingredients which do not interfere with the performance of the colorless dye or dye developing compound. For example, the substrate may be precoated with a pigment or other coating to indicate the position of the dye developing layer and/or the microcapsule layer. Either or both layers may contain fragrances to enhance the aesthetics of the coated substrates. One or both substrates may contain printed indicia or figures for functional or ornamental purposes. Numerous other modifications, substitutions and additions may be made to the invention within the spirit and scope of the appended claims by those of ordinary skill.

What is claimed is:

1. A printing system comprising, in combination:

a first substrate region containing an essentially dry layer comprising a plurality of microcapsules wherein the microcapsules contain a colorless dye solution;

an image containing device for contact with the microcapsule layer of the substrate, the image containing device having a rigid base, a handle fixedly attached to one surface of the base and an image having a raised portion attached to an opposing surface of the base; and an image receiving second substrate region for contact with the image containing device wherein the image receiving substrate comprises an substantially dry layer of a dye developing compound.

2. The printing system according to claim 1 wherein the microcapsules have a spherical diameter within the range of from about 40 to about 80 microns.

3. The printing system according to claim 1 wherein the dye of the dye solution comprises an electron donating dye.

4. The printing system according to claim 3 wherein the dye comprises a vat dye.

5. The printing system according to claim 1 wherein the dye developing compound comprises an electron accepting phenolic derivative.

6. The printing system according to claim 5 wherein the phenolic derivative comprises an alkylphenol novolac resin.

7. The printing system according claim 1 wherein the microcapsules contain from about 10 to about 20 weight percent colorless dye and from about 80 to about 90 weight percent of a citrus oil.

8. A disposable ink pad and an image producing system comprising an object having surface relief and a paper or paperboard substrate having printed thereon in a first region on a surface of the substrate an essentially dry layer of microcapsules and binder wherein from about 50 to about 99 percent of the microcapsules by weight is a colorless dye solution for depositing a colorless dye on the object and having printed thereon in a second coplanar region on the surface of the substrate a substantially dry dye developing layer for receiving the colorless dye from the object to produce an image of the object on the substrate in the second region.

9. The system according to claim 8 wherein the microcapsules of the microcapsule layer have a spherical diameter within the range of from about 40 to about 80 microns.

10. The system according to claim 8 wherein the dye comprises an electron donating dye.

11. The system according to claim 10 wherein the dye comprises a water soluble vat dye.

12. The system according to claim 8 wherein the dye developing layer comprises an electron accepting phenolic derivative.

13. The system pad according to claim 12 wherein the phenolic derivative comprises an alkylphenol novolac resin.

14. The system according claim 8 wherein the microcapsules contain from about 10 to about 20 weight percent colorless dye and from about 80 to about 90 weight percent of a citrus oil.

15. The printing system of claim 8 wherein the object having surface relief comprises a finger or thumb.

16. A disposable ink pad and an image producing system comprising an object having surface relief and a paper or paperboard substrate having printed thereon in a first region on a surface of the substrate an essentially dry layer of microcapsules containing a dye developing solution for depositing the solution on the object and having printed thereon in a second coplanar region on the surface of the substrate a substantially dry colorless dye layer for receiving the dye developing solution from the object to produce an image of the object on the substrate in the second region, wherein the microcapsules of the microcapsule layer have a spherical diameter within the range of from about 40 to about 80 microns and the dye comprises an electron donating dye.

17. The system of claim 16 wherein the microcapsules contain from about 10 to about 20 weight percent dye developing compound and from about 80 to about 90 weight percent of a citrus oil.

18. The system according to claim 16 wherein dye developing solution comprises an electron accepting phenolic derivative.

19. The printing system of claim 16 wherein the object having surface relief comprises a finger or thumb.

20. An image producing system comprising an object having surface relief and a first substrate region comprising an essentially dry layer of fluid filled microcapsules and binder wherein the microcapsules have an average spherical diameter of from about 40 to about 80 microns and contain a fluid selected from the group consisting of colorless dye solutions and dye developing solutions and a second substrate region having printed thereon a substantially dry compound which compound is reactive with the fluid and wherein the compound is printed on the second substrate region in the shape of text or a design which printed compound is substantially imperceptible prior to reaction with the microcapsule fluid and wherein the printed compound becomes visible subsequent to reaction with the microcapsule fluid.

21. The image producing system of claim 20 wherein the fluid in the microcapsules comprises a colorless vat dye and wherein the substantially dry compound comprises a dye developing compound.

22. The image producing system of claim 21 wherein the fluid in the microcapsules comprises about 10 to about 20 weight percent colorless dye and from about 80 to about 90 weight percent of a citrus oil.

23. The image producing system of claim 22 wherein the dye developing compound comprises an alkylphenol novolac resin.

24. The image producing system of claim 20 wherein the fluid in the microcapsules comprises a dye developing solution and wherein the substantially dry compound comprises of a colorless vat dye.

25. The image producing system of claim 24 wherein the dye developing solution is an alkylphenol novolac resin solution.

* * * * *

UNITED STATES PATENT AND TRADEMARK OFFICE

CERTIFICATE OF CORRECTION

PATENT NO : 5,707,924

DATED : January 13, 1998

INVENTOR(S) : Larry F. Vaughn and John G. Whitaker

It is certified that error appears in the above-identified patent and that said Letters Patent is hereby corrected as shown below:

In the Abstract:

In line 1, after "methods" change "mid" to -- and --.

Column 1, line 26, change "an" to -- a --.

Column 2, line 32, change "slot" to -- not --.

Signed and Sealed this

Twenty-fourth Day of March, 1998

*Attest:*

Bruce Lehman

BRUCE LEHMAN

*Attesting Officer*

*Commissioner of Patents and Trademarks*